US007760149B2

(12) United States Patent
Höök

(10) Patent No.: US 7,760,149 B2
(45) Date of Patent: Jul. 20, 2010

(54) HULL OR FUSELAGE INTEGRATED ANTENNA

(75) Inventor: Anders Höök, Hindås (SE)

(73) Assignee: SAAB AB, Linköping (SE)

( * ) Notice: Subject to any disclaimer, the term of this patent is extended or adjusted under 35 U.S.C. 154(b) by 55 days.

(21) Appl. No.: 12/073,116

(22) Filed: Feb. 29, 2008

(65) Prior Publication Data

US 2008/0316124 A1 Dec. 25, 2008

(30) Foreign Application Priority Data

Mar. 2, 2007 (EP) ..... 07446003

(51) Int. Cl.
*H01Q 1/28* (2006.01)

(52) U.S. Cl. ..... 343/708; 343/770

(58) Field of Classification Search ..... 343/705, 343/708, 700 MS, 853, 770, 795
See application file for complete search history.

(56) References Cited

U.S. PATENT DOCUMENTS 3,409,891 A 11/1968 Lode
4,684,952 A * 8/1987 Munson et al. ..... 343/700 MS

FOREIGN PATENT DOCUMENTS

WO WO-2005/069442 A1 7/2005
WO WO-2006/091162 A1 8/2006

OTHER PUBLICATIONS

J. L. Volakis et al.; Broadband RCS Reduction of Rectangular Patch by Using Distributed Loading; Electronics Letters; Dec. 3, 1992, vol. 28, No. 25; pp. 2322-2323.

* cited by examiner

*Primary Examiner*—Michael C Wimer
(74) *Attorney, Agent, or Firm*—Venable LLP; Eric J. Franklin

(57) ABSTRACT

An antenna structure integrated in a hull or fuselage. The hull or fuselage can be the outer surface of an aircraft, artillery shell, missile or ship. The antenna structure includes an array antenna. The array antenna includes a number of antenna elements. Each antenna element includes a radiator and an RF feed. The antenna elements are arranged in a lattice within an antenna area including a central antenna area and a transition region outside the central antenna area wherein a number of the antenna radiators as well as resistive sheets are arranged in substantially the same plane as a surrounding outer surface of the hull or fuselage.

31 Claims, 10 Drawing Sheets

FIG.15a-d

HULL OR FUSELAGE INTEGRATED ANTENNA

CROSS-REFERENCE TO RELATED APPLICATIONS

This application claims priority to European patent application 07446003.1 filed 2 Mar. 2007.

TECHNICAL FIELD

The present invention relates to hull or fuselage integrated antennas.

BACKGROUND ART

There is a need today for creating a low radar signature for different objects such as e.g. aircrafts, i.e. to design aircrafts having a low radar visibility. Significant progress has been achieved in a number of problem areas as e.g.:

Intake/exhaust
Cockpit/canopy
Hull or fuselage shape
Absorbers
Armament but there is often a problem with reducing the passive signature of the aircraft sensors such as antennas.

A number of solutions have been proposed for antennas with a low radar signature or a low Radar Cross Section, RCS.

Antennas, as e.g. radar antennas in aircrafts, are often so-called array antennas i.e. antennas consisting of a number of antenna elements working together. In order to reduce the RCS of array antennas in a conductive hull WO 2006/091162 has proposed to frame the array with a thin and tapered resistive sheet. FIG. 1 shows a cross section of an antenna according to prior art. An antenna unit 101 with antenna radiators 102 and a dielectric cover 103 is mounted in a hull 104. A tapered resistive sheet 105 is applied as a frame on top of the antenna unit 101. By tapered is understood that the resistivity varies from "high resistivity" nearest to the antenna centre to "low resistivity" nearest to the conductive hull. This method is able to reduce the backscattering caused by discontinuities between antenna area and hull or fuselage substantially.

Although efficient this method has a problem with a relative high phase depth $\Delta\phi$, see FIG. 1. $\Delta\phi$, 106, is the difference in reflected phase from the hull and from the array region causing a large RCS.

The array is usually much thicker than the hull or fuselage, thus allocating an unnecessarily large volume in the aircraft.

Irrespective of array thickness, the integration causes a weakening of the hull or fuselage since the RF-active (RF=Radio Frequency), low loss materials in the array usually can not bear much mechanical stress. Extra, weight-consuming reinforcements must then be devised.

By applying the resistive layer at a significant height above the antenna radiators, a transmitted beam interferes with the resistive layer at moderate scan angels. This necessitates the introduction of a comparably large transition region (i.e. resistive sheet) which in turn makes the aperture in the hull or fuselage larger than necessary. FIG. 2 schematically illustrates the parameters affecting the width of the transition region. Antenna radiators 203 are located at a certain distance 204 from a hull 201. A first part 205 of the transition region is primarily depending on the operating frequency and shall have a width of $N*\lambda$. Normally it is sufficient with N=1-8.

Higher N-values may however be necessary if very large RCS reductions are required. A second part of the transition region 207 is a function of the phase depth difference $\Delta\phi$ which exhibits some degree of proportionality to the distance 204. Finally a third part 209 of the transition region is a function of a scan angle $\alpha$, also designated 211. A large scan angle means that the section 209 has to be wider which leads to the total transition region becoming larger.

This solution is most efficient for TE incidence (Transverse Electric polarization), but not for TM incidence (Transverse Magnetic polarization). The generally acknowledged solution to this problem is to introduce further (e.g. bulk-) absorbers inside the antenna near its edges. But again, this is associated with extra costs and increased width of the transition region. FIG. 3 explains the difference in handling of a TE wave, FIG. 3*a*, and TM wave, FIG. 3*b*, with a hull 301, an antenna 302 and a resistive sheet 303. An incident wave 305 propagates in the direction of the arrow. For a TE-wave the E-field is perpendicular to the plane of the paper illustrated with a circle and a dot. A TM-wave has the magnetic field in the same direction as the E-field in FIG. 3*a*. The E-field for the TM-wave is shown with an arrow 306. This means that the E-field for a TE-wave will have a direction along the resistive sheet and will be absorbed by the sheet. The TM-wave however will only have a small component in the direction along the resistive sheet and will therefore only be absorbed by the sheet to a small degree. The TM-wave will instead scatter at the antenna edge. A way to decrease this scattering is to include an absorbing material 307 at the end of the antenna. This however increases the width of the antenna and adds costs.

Gradually changing of the reflection coefficients, $\Gamma_n$, of the antenna radiators by introducing small changes of the element internal geometry that would give rise to a change of the reflection coefficient $\Gamma$ has also been suggested as a means to reduce RCS. The proposition showed in FIG. 4 is aimed at changing the reflection coefficient $\Gamma$ of dual-polarized antenna elements over the entire array surface, whilst keeping the transmit/receive losses as low as possible. Hence, reactive (capacitive/inductive) changes were considered, rather than resistive. FIG. 4 shows antenna radiators, in this case realized as waveguides, 401 with perturbations 402 and a hull 403. In the diagram of FIG. 4 a vertical axis 404 represents the reflection coefficient $\Gamma_n$, and a horizontal axis 405 represents the position of each antenna element n. The perturbations 402 are designed such that the reflection coefficient $\Gamma$ is high close the outer edges of the antenna where the antenna meets the hull and low in the middle of the antenna thus creating a smooth transition from the high reflection coefficient of the hull to the low reflection coefficient of the antenna. This smooth transition reduces scattering and thus the RCS.

A drawback with this solution is that the reactive character of the perturbations implies that the signature reduction is only efficient over a limited bandwidth.

Another drawback is also that it is a very costly procedure to design a large number of individual antenna elements.

The method requires either that both polarisations be terminated and using dual polarized perturbations or, which is possible only in principle, that only one polarisation is terminated whilst introducing a single-polarized perturbation. The requirement that both polarizations be properly terminated is extra costly if the antenna function only requires one single polarization.

The phase depth 406 of the scattering is also a problem; it is not always possible to introduce the reactive perturbations in the plane where it would be optimal which is at the same level as a ground plane.

As mentioned above there are different types of backscattering causing a high RCS:

Edge scattering caused by discontinuities between antenna area and hull. This kind of scattering can be dealt with by applying a resistive layer as discussed above. The strength of the edge scattering is affected also by $\Delta\phi$, i.e. the phase difference between the reflected signals from the hull and the antenna region. This scattering can to some extent be reduced by making the antenna as thin as possible.

Grating lobes scattering which will be discussed more in detail below.

There is thus a need for an improved antenna solution integrated in the hull and having a low RCS at the same time as it is light weight and cost effective to produce.

DISCLOSURE OF INVENTION

It is therefore the object of invention to provide a hull or fuselage integrated low RCS array antenna with a number of antenna elements, each antenna element comprising a radiator, and an RF-feed, the antenna elements being arranged in a lattice within an antenna area comprising a central antenna area and a transition region outside the central antenna area, which can solve the problem to achieve a very low RCS and at the same time be light weight and cost effective to manufacture.

This object is achieved by an antenna structure integrated in a hull or fuselage, wherein the antenna structure comprises an array antenna, the array antenna comprising a number of antenna elements, each antenna element comprising a radiator and an RF-feed, the antenna elements being arranged in a lattice within an antenna area comprising a central antenna area and a transition region outside the central antenna area, wherein a number of the antenna radiators as well as resistive sheets are arranged in substantially the same plane as a surrounding outer surface of the hull or fuselage.

Each antenna radiator in the transition region has a corresponding resistive sheet either covering or surrounding the radiator.

An antenna element is henceforth defined as a radiator and an RF-feed arrangement to the radiator. The radiator can be a slot, a crossed slot, a circular or rectangular hole, a patch, a dipole e.t.c. The RF-feed arrangements comprises conventional means to supply RF-energy to the radiator such as probes inserted in cavities, the cavities being attached to the radiator, or direct galvanic connections by means of strips, wires e.t.c.

An array antenna is a number of antenna elements working together.

The invention describes a transition region with antenna radiators covered or surrounded with thin, 0.00001-1 mm, resistive sheets. The lower part of the range is typical when using metal vapour deposition technique to realize the sheet and the higher part of the range may be typical when using a semiconductive paste. A resistive sheet is henceforth meant as a layer of resistive material with the aforementioned thickness. The conductivity of the sheets close to the hull is high and then decreasing in the direction towards the central antenna area, thus providing a tapered adjustment in reflection coefficient covering substantial parts of the frequency interval 0.5-40 GHz. A typical embodiment may offer a good tapered adjustment within a bandwidth of up to 3 octaves. However both narrower and wider band widths, depending on the operating frequency, are within the scope of the invention.

An important feature of the invention is that a number of radiators with the corresponding resistive sheets are arranged in substantially the same plane as the surrounding outer surface of the hull or fuselage.

Moreover, the invention offers the additional advantages of low RCS in combination with low extra weight, surface conformity and small integration depth.

The antenna can e.g. be integrated in the hull or fuselage of an aircraft, artillery shell, missile or ship.

Further advantages with the invention are attained if the antenna structure is given one or several features such as e.g.

"Full"-strength integration; directly in the hull or fuselage by slotting.

Easy manufacturing by being able to pre-produce and test the complete antenna unit mounted on a plate or a dielectric substrate on a ground plate where the plate is designed to fit into the hull or fuselage aperture. The plate can be an existing hatch to the hull or fuselage.

The dielectric material in the slot and cavity can be of the same type thus allowing easy manufacturing in one piece.

The dielectric material of the cavity and slot can be manufactured from processing of standard PCB laminate (s).

The cavity box can be integrated with the dielectric filling of the box by applying a conductive plating to the dielectric material.

Implementing bulk absorbers or vertically oriented resistive cards at end sections to increase absorption of TM-incidence.

The invention can be easily fitted into a curved hull or fuselage.

Environmental protection can be achieved by adding an outer protective skin covering the antenna area.

The antenna can be integrated in a hatch covering an opening in the hull or fuselage.

BRIEF DESCRIPTION OF DRAWINGS

The present invention will become more fully understood from the detailed description given below in the accompanying drawings which are given by way of illustration only, and thus are not limiting for the invention and wherein.

EMBODIMENT(S) OF THE INVENTION

The invention will in the following be described in detail with reference to the drawings.

FIGS. 1-4 have already been described in relation to Background art above.

Figure 5:
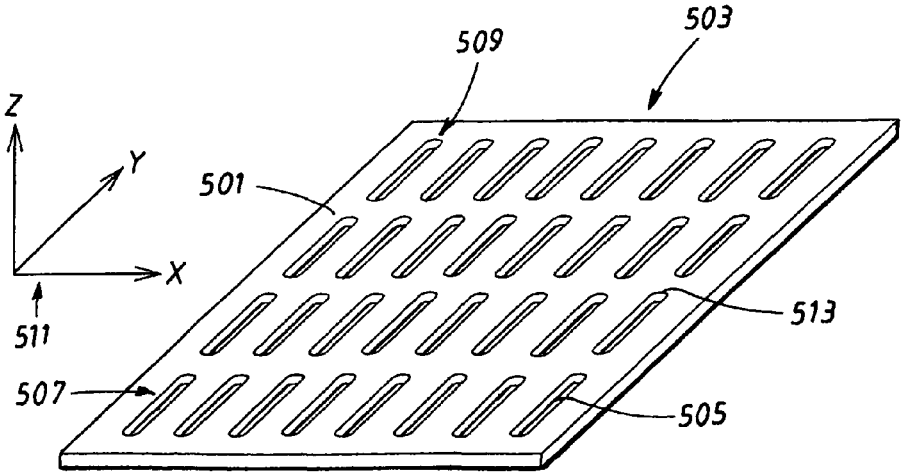
FIG. 5 schematically shows a perspective view of a slot element array in a hull or fuselage.

FIG. 5 shows a perspective view of a slot element array 503 being part of a hull or fuselage 501 or a hatch in the hull or fuselage, the hull or fuselage also serving as a ground plane surrounding the radiators. Slots 505 have been made directly in the hull or fuselage e.g. by milling. The array consists of a number of slots arranged in horizontal slot rows 507 and vertical slot columns 509, making up a so-called rectangular lattice. Each slot has the same dimensions and the slot size is dimensioned such that a suitable frequency is obtained according to rules well known to the skilled person. Typical length of a slot is half the wavelength, $\lambda/2$. A coordinate symbol 511 defines the x-, y- and z-axis in FIG. 5.

The slots in the slot row 507 are in parallel and a top edge 513 of each slot has the same y-coordinate value. The distance between neighbouring slots is constant as well as the distance between neighbouring slot rows.

The slots in the slot column 509 all have the same x-coordinate values.

Instead of making the slots directly into the hull or fuselage, an aperture can be made in the hull or fuselage and a plate with the slot configuration described above and with the dimensions of the aperture is inserted in the aperture and mounted such as the surface of the plate will be flush with the hull or fuselage surface. The hull or fuselage surface can be flat or curved which means that the plate is shaped so as to conform to the hull or fuselage surface leaving no discontinuities except for the slots. The plate can be made of metal or carbon reinforced composite or any other mechanically strong conductive material.

In an embodiment the slots are filled with mechanically strong dielectric material in order to restore the strength that becomes reduced when slotting or drilling.

As well known to the skilled person there will be no RCS contribution at cross polarization up to frequencies where the wave length is equal to two slot widths. Since the slot width can be made quite narrow, good RCS properties at cross polarized waves are obtained for high frequencies, e.g. well above the first slot resonance. With a slot width of 3 mm this corresponds to a frequency of 50 GHz under which there will be no RCS contributions. As operating radar frequencies are 1-40 GHz, typically 8-12 GHz (the so-called X-band) giving a wavelength of about 3 cm, there will be no RCS in the operating frequency band with a slot width of 3 mm.

The length of the slot should be around $\lambda/2$ i.e. a typical slot length for a 10 GHz antenna is 1.5 cm.

As is well known to the skilled person extremely low RCS for co-polarized waves from 0 Hz up to the slot cut off frequency can be obtained, which in turn is slightly below the lowest functional frequency of the array.

Figure 6:
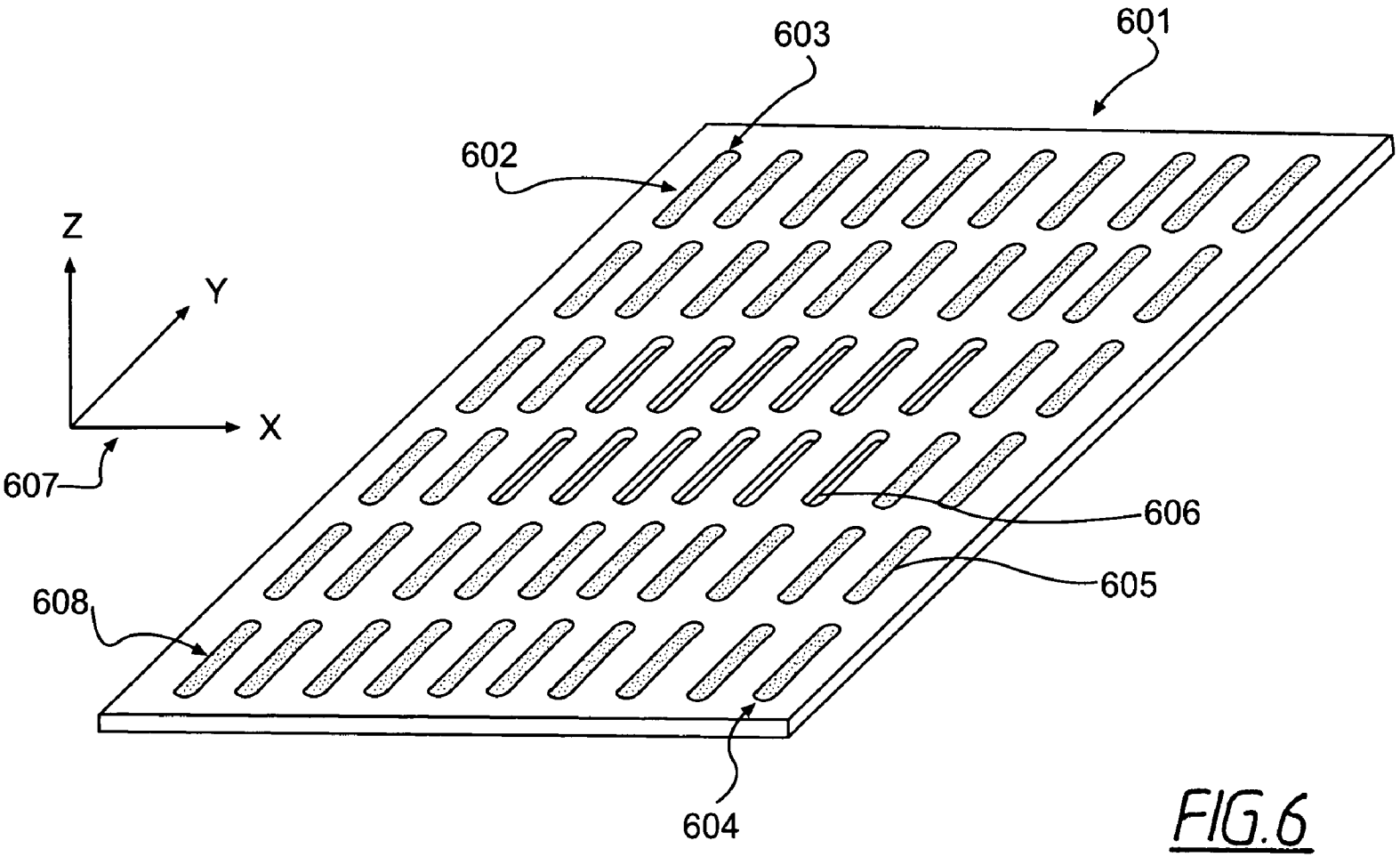
FIG. 6 schematically shows a perspective view of a slot element array with resistive coating of edge slots according to the invention.

In order to reduce the edge scattering contribution to the RCS for incident waves at frequencies above the slot cut-off, but below the frequency above which grating lobes occur, the dielectric-filled slots around the edge of a slot element array 601 in FIG. 6 are covered with a thin, 0.00001-1 mm, slot-shaped resistive sheet 605. The lower part of the range is typical when using metal vapour deposition technique to realize the sheet and the higher part of the range may be typical when using a semiconductive paste. FIG. 6 shows the slot element array with 10 columns and 6 rows i.e. in total 60 slots in a rectangular lattice. Coordinate symbol 607 defines the x-, y- and z-axis in FIG. 6. The slots are defined according to x/y-coordinate where x is the column and y is the row. Slot 606 is thus designated 8/3. Slots covered with a thin resistive sheet are marked black. The slot 606 is thus not covered with a sheet. This means that all slots in slot rows 602 and 608 and in slot columns 603 and 604 are covered with this thin resistive coating. These slots form a first ring of sheet-covered slots also being defined as slots 1/1-10/1, 1/6-10/6, 1/2-1/5 and 10/2-10/5. A second ring of sheet-covered slots consists of slots 2/2-9/2, 2/5-9/5, 2/3-2/4 and 9/3-9/4. The sheets closest to the hull or fuselage shall have a low resistivity, while sheets closer to the antenna centre shall have a higher resistivity. This means that the slots in the second ring have a higher resistivity than the slots in the first ring. The slots in the central antenna area, or active part of the antenna, should not be covered with resistive sheets. FIG. 6 shows an example where the transition region, i.e. the region between the area of the hull or fuselage with high reflection coefficient and the area of the antenna with low reflection coefficient, has two rings of slots covered with the resistive sheets. This means that in the transition region each radiator, in this case a slot, has a corresponding resistive sheet. It is of course possible within the scope of the invention to have transition regions comprising 1, 3, 4 rings of slots or more covered with resistive sheets.

The transition region accomplishes that the surface properties, such as the reflection coefficient will change gradually from the hull or fuselage, over the slotted transition region to the central antenna area. As a consequence the backscattering and hence the RCS will be reduced. Another way to put it is that the invention provides a tapered adjustment in reflection coefficient over a wide frequency interval.

Figure 7:
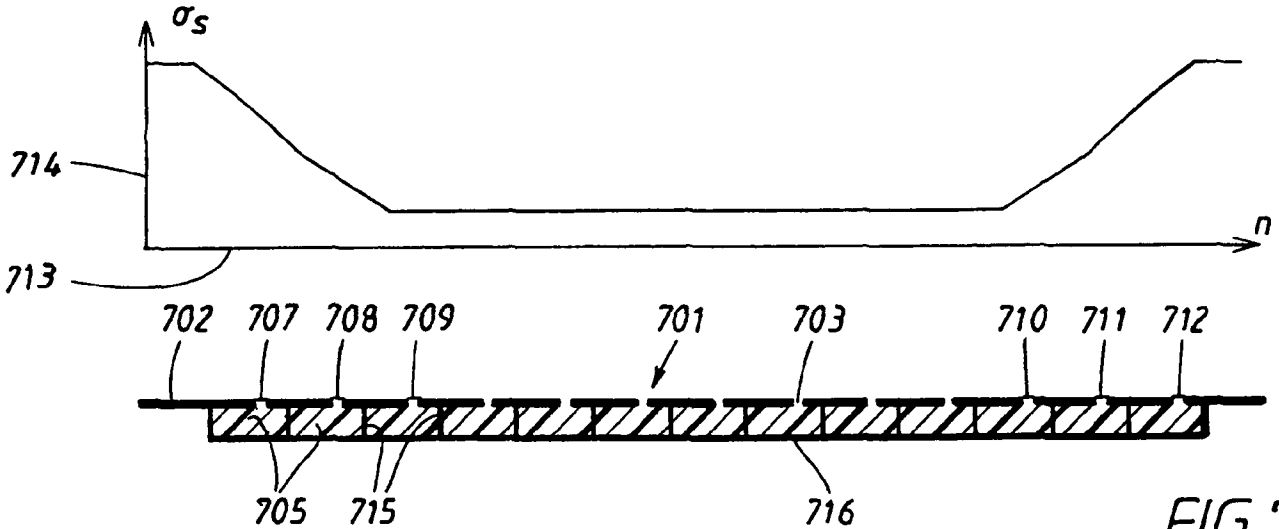
FIG. 7 schematically shows a cross section of the antenna structure according to the invention including a diagram of the variation of the surface conductivity with the position along a cross section of the antenna.
Figure 11:
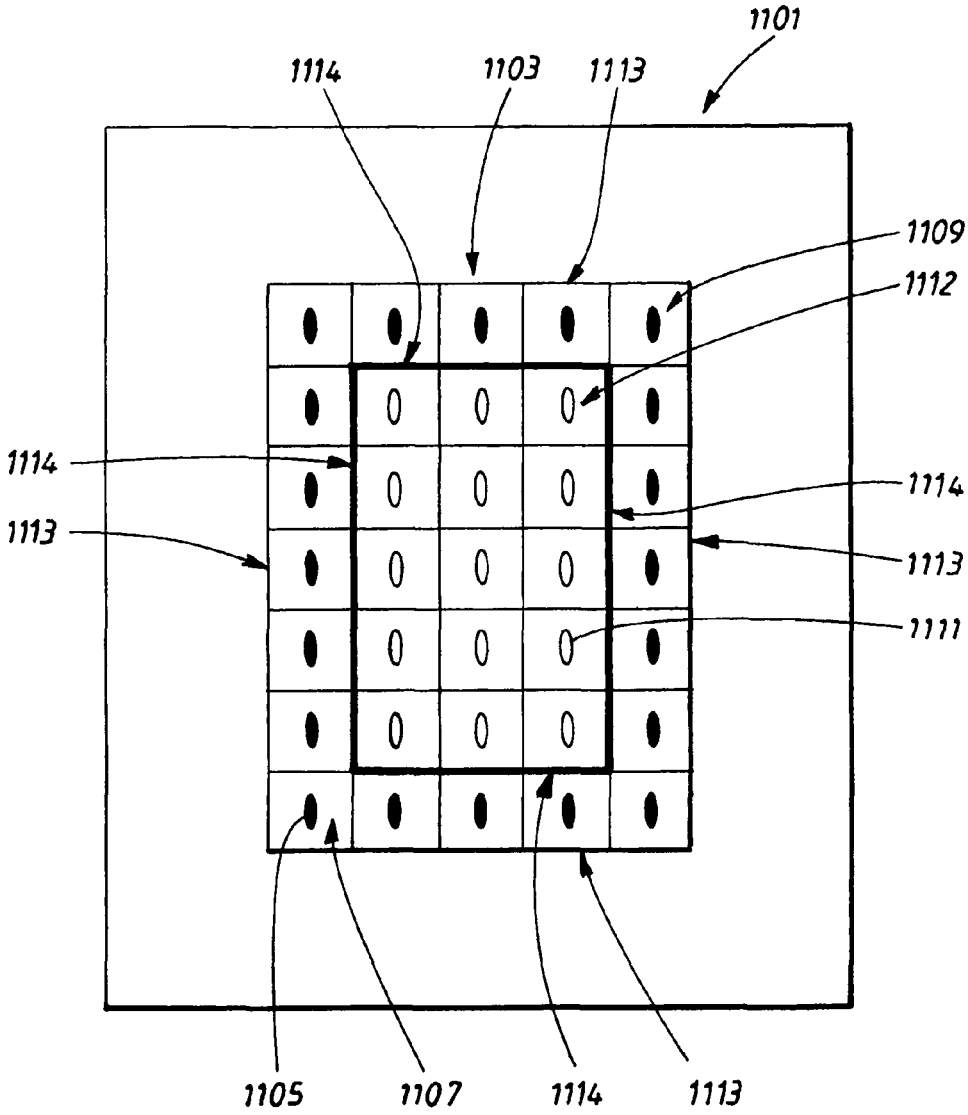
FIG. 11 schematically shows a top view of the slot element array.

FIG. 7 shows in cross section a slotted array 701 with slots made directly in the hull or fuselage 702 according to the invention. Each slot 703 is filled with a dielectric material and each slot is directly connected to a dielectric filled cavity 705. Each cavity is enclosed in a metallic box with a bottom 716 and side walls 715. In an embodiment there is a hole for insertion of an RF-feed probe at the bottom 716 of each cavity. However RF-energy can be fed into the cavity in many other ways as well known to the skilled person. The cavity 705 is described more in detail in FIG. 8 below. The dielectric filling of the cavity and the slot may be the same but the slot filling has advantageously a similar elasticity modulus to that of the hull or fuselage. Resistive sheets 707-712 are covering the slots closest to the hull or fuselage. In this embodiment the transition region thus comprises three rings of radiators. The transition region is illustrated in FIG. 11. The resistivity is low on the outer sheets 707 and 712, higher for the sheets 708 and 711 and highest for the sheets 709 and 710 thus creating the tapered adjustment of the reflection coefficient.

The variation of the surface conductivity along the surface of the antenna array is shown in the diagram in FIG. 7. An X-axis 713 represents the position of each antenna element n and a y-axis 714 is the slot surface conductivity $\sigma_s$. Consequently, the reflection coefficient is high at the hull or fuselage area as the hull or fuselage is a good reflector when the hull or fuselage is made of a material such as metal or carbon reinforced composite and the reflection coefficient $\Gamma=1$. In the central antenna area the unit cell reflection coefficient $\Gamma$ is low and in the transition region, i.e. the region with the sheet-covered slots, the reflection coefficient is gradually reduced towards the centre of the antenna.

Figure 1:
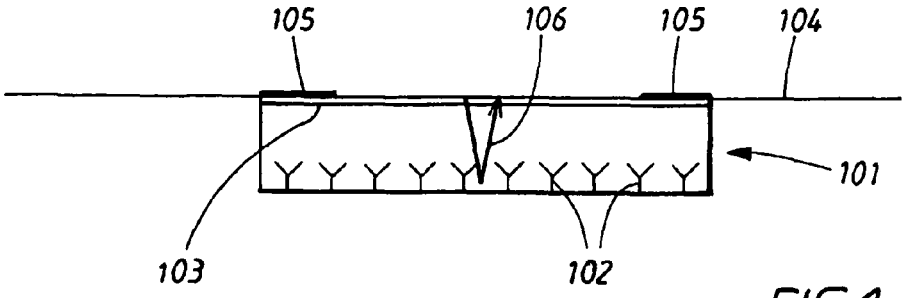
FIG. 1 schematically shows a cross section of an antenna array with resistive sheet according to prior art.
Figure 2:
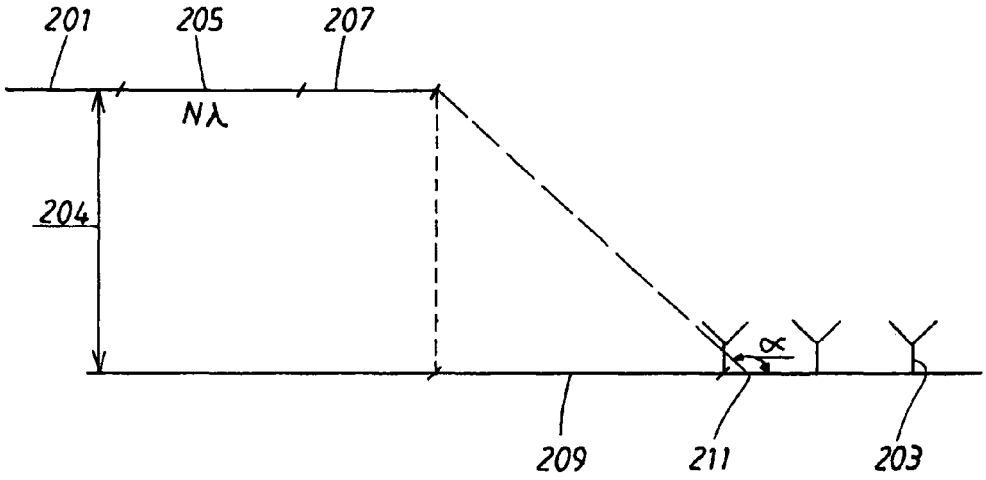
FIG. 2 schematically shows a cross section of a prior art antenna illustrating the parameters deciding the width of the region with antenna radiators covered with resistive sheet.
Figure 3A:
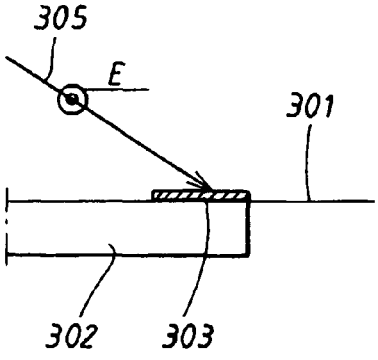
FIG. 3 schematically illustrates how TE and TM waves are absorbed by the resistive sheet.
Figure 3B:
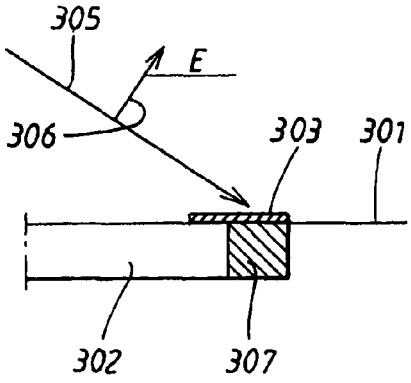
Figure 4:
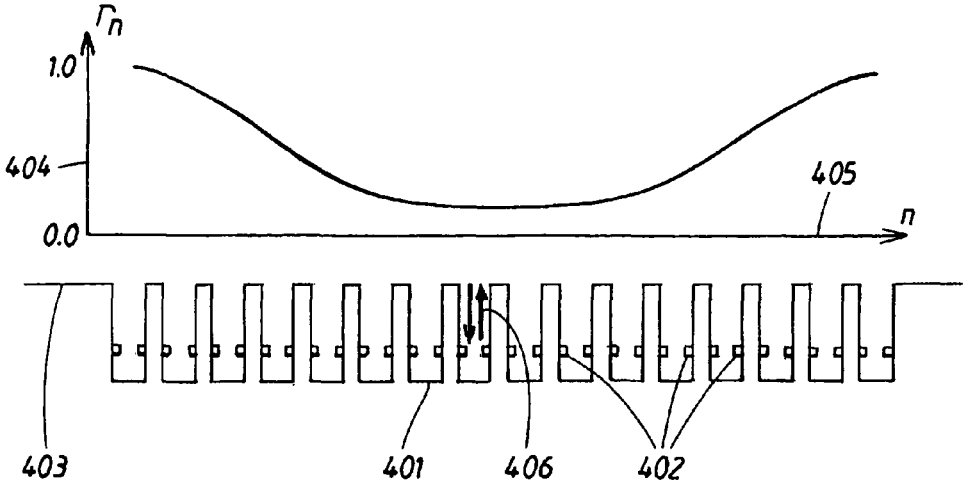
FIG. 4 schematically shows a cross section of a prior art antenna solution with tapered matching over the aperture showing also the variation of the reflection coefficient over the aperture area.

In order to minimize the RCS it is an advantage that the radiators with the corresponding resistive sheets covering the radiators are arranged in substantially the same plane as the surrounding outer surface of the hull or fuselage, the difference being only the thickness of the resistive sheets and possibly also the thickness of an environmental protective skin covering the antenna area and overlapping also part of the hull or fuselage area. With reference to FIG. 2 this corresponds to the situation when the distance 204 becomes zero. The transition region will in this case comprise of sections 205 and 207.

Figure 8:
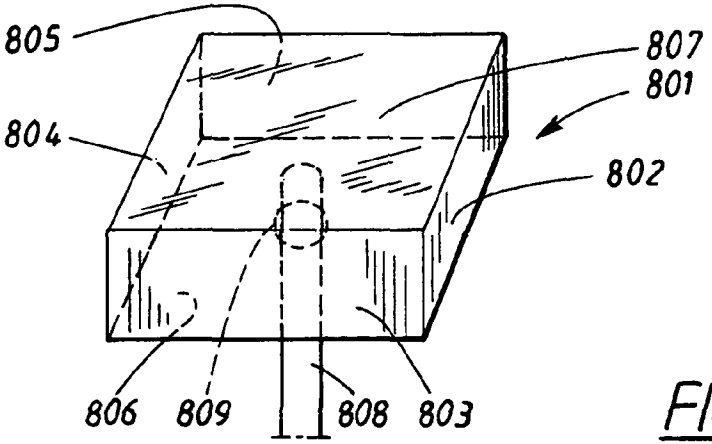
FIG. 8 schematically shows a perspective view of a cavity.

FIG. 8 is a perspective view of a cavity, 801. The cavity comprises conductive walls 802, 803, 804 and 805 on each side of a slot, extending substantially perpendicular to the hull or fuselage and inwards and being in galvanic or capacitive contact with the hull or fuselage. A wall 806, the bottom part, connects the free ends of the walls 802-805 and galvanically connects these walls. The cavity is thus a box open at a top 807 and mounted with the opening towards the hull or fuselage. The fastening to the hull or fuselage can be made by any conventional methods as long as a galvanic contact between hull or fuselage and the walls 802-805 is ensured. RF-feed is accomplished with a probe 808 inserted into the cavity through a hole 809. The probe can be of any conventional type well known to the skilled person.

Figure 9:
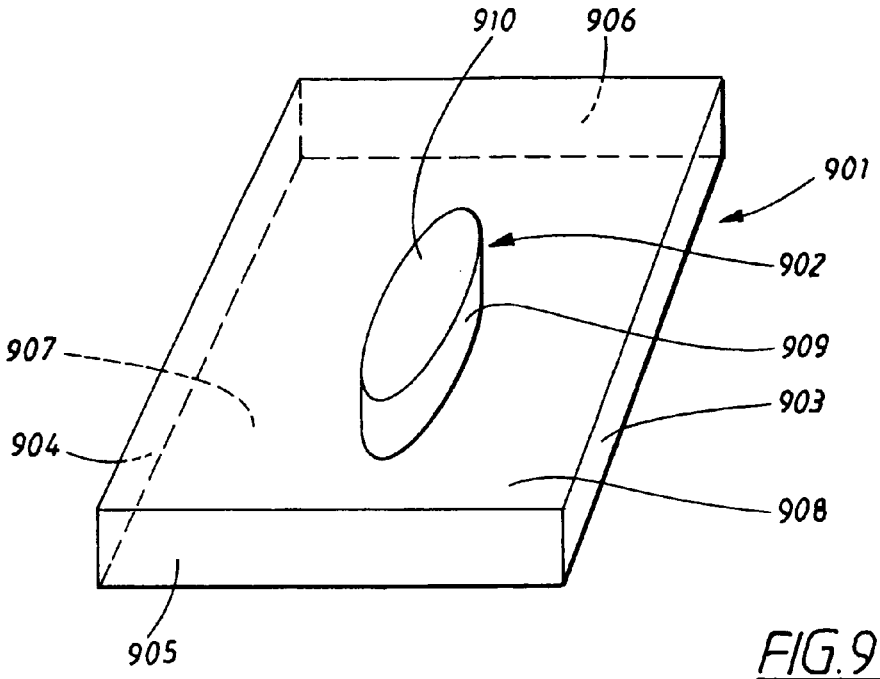
FIG. 9 schematically shows a perspective view of an embodiment of a cavity with integrated slot filling of dielectric material. The slot filling of dielectric material henceforth called plug.

FIG. 9 shows in perspective view an embodiment of a cavity 901 made of a dielectric material, and a plug 902 also made of a dielectric material. All surfaces 903-908 are metallised as well as the sideways facing surfaces 909 of the slot shaped dielectric plug 902. The only surface not metallised is a surface 910 and a corresponding part of the surface 908. The complete piece, comprising the cavity and the plug can be mounted on the slotted hull or fuselage by inserting the plug into the slot. Through e.g. the bottom surface 907 there will be a hole for inserting the RF-feed probe, not shown in the figure. The dielectric material for the cavity 901 and the plug 902 can be the same or of different types having different dielectric constants. A further possibility is that the dielectric material in the cavity and the filling consists of several layers of dielectric material each having a different dielectric constant in order to optimize antenna performance. Alternatively instead of metallizing the side surfaces 903-907 the dielectric piece 901 can be put in a metal box as described in association with FIG. 8 above.

Figure 10:
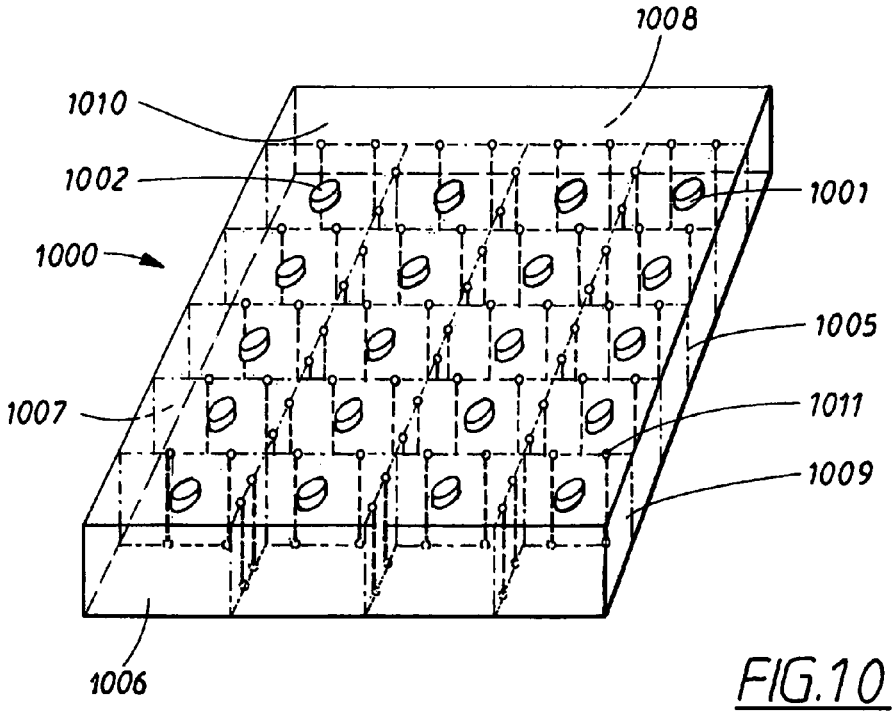
FIG. 10 schematically shows a perspective view of an embodiment of cavities and plugs for a slot array antenna.

FIG. 10 shows a perspective view of an alternative embodiment of how to realize a slot array antenna from standard types of Printed Circuit Board (PCB) materials. The dielectric constants for the PCB:s should preferably be below 4, but also higher values can be considered. The top surface of the PCB is milled such as a number of dielectric slot shaped elements, or plugs, 1001 remain. There are vertical through plated channels 1011, together acting as electrically separating walls between the cavities. The number of through plated channels must be adapted to the operating frequency and chosen such as to obtain a sufficient confinement for the electromagnetic field in the cavity. All side surfaces 1005-1008 are metallised as well as a bottom surface 1009, a top surface 1010 and the sideways facing surfaces of the slot shaped dielectric plug 1001. The only non metallised surface is the top surface 1002 of the slot shaped dielectric plug and a corresponding part of the surface 1010. The metallised through platings create a rectangular lattice of dielectric "islands" each with a slot shaped dielectric plug. Each "island" has metallised sides, by means of the through plated channels, bottom and top surfaces as well as metallised envelope surface of the dielectric slot shaped plug 1001. Each "island" has a hole e.g. in the bottom surface for inserting the RF-feed probe (not shown in the figure) as described in association with FIG. 8. The complete dielectric unit 1000 can be plugged into a lattice of slots in a hull or fuselage having the corresponding pattern as the slot shaped elements on the dielectric unit. The shape of the dielectric unit can be flat or curved so as to fit for a flush mounting towards the hull or fuselage.

FIG. 11 is a top view showing the hull or fuselage 1101 with an antenna area 1103, slots 1105, cavities 1107, a transition region 1109, between borderlines 1113 and 1114, and a central antenna area 1112, within border line 1114. Slots, e.g. 1105, in the transition region are covered with resistive sheets, marked black, while the slots, e.g. 1111, in the central area of the antenna are uncovered. The cavities in this embodiment can be separate boxes of conductive material such as metal mounted to the hull or fuselage or an arrangement according to FIG. 10.

It is perfectly possible to realize the proposed invention in a curved hull or fuselage. In any case, the cavities can either be assembled afterwards, on an existing, slotted hull or fuselage, or, be assembled on a plate which subsequently is fitted into the hull or fuselage.

The cavities are RF-fed by standard arrangements, well known to the skilled person, e.g. by probes protruding from below.

A slot element is defined as a slot filled with a dielectric material and directly attached to the cavity 1107, possibly filled with a dielectric material and including an RF-feed arrangement e.g. according to FIG. 8. The slot element can be covered with the resistive film or be uncovered.

In an embodiment the dielectric material in the slot and cavity is the same and it can be fabricated in one piece. If there are different dielectric materials in the slot and the cavity the two dielectric elements can be manufactured in a two shot moulding process or attached by any conventional method.

In an embodiment a part of, or all of, the dielectric material of the cavity can be air.

Only elements in the transition region are treated with the resistive sheets. If there is a need to transmit at high power one should consider the elements in the transition region as being inactive, so-called dummy elements. This means that the cavities belonging to these slots are not RF-fed.

If the hull or fuselage is made of carbon reinforced composite it may be needed to enhance the conductivity of slot walls by insertions, plating or other standard methods. An alternative has been described in FIGS. 9 and 10 where the sideways facing surfaces of the slot shaped dielectric plug have been metallised.

Figure 12:
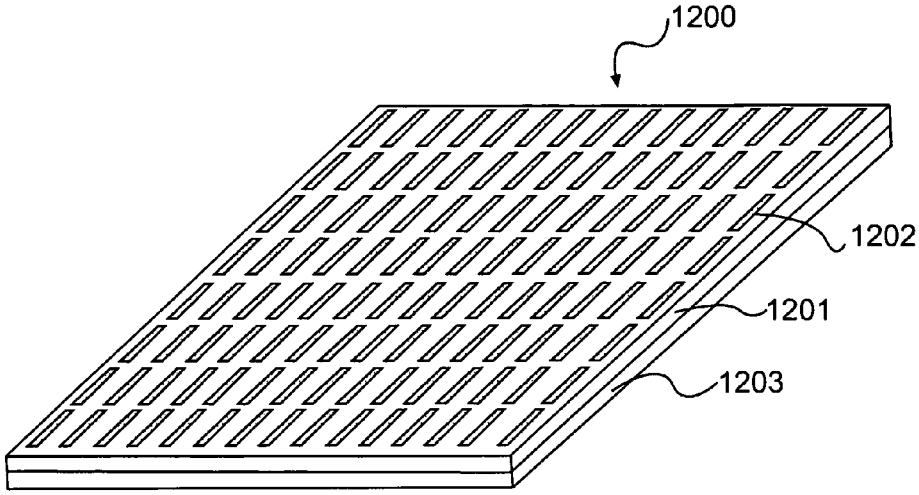
FIG. 12 schematically shows a perspective view of a dipole array antenna.

The invention can also be applied to antenna arrays based on a dielectric substrate or substrates, having a top surface and a bottom surface, and thin radiators. The radiators can be made of metal or any other suitable high conductive material. FIG. 12 shows an example of a one layer dielectric substrate with radiators on the top surface. The bottom surface is either metal-plated or mounted on a separate antenna ground plane being in electrical contact with the hull or fuselage. The top surface of the dielectric substrate is conforming to the surface of the hull or fuselage. The RF-feed to the radiator can be accomplished through wires or microstrips in galvanic contact to the radiators or through electromagnetic coupling to an RF-aperture. The feeding principle can be of unbalanced or balanced type and the radiators can be e.g. dipoles, crossed dipoles, patches, fragmented patches as well-known to the skilled person. A dipole array antenna 1200 of FIG. 12 comprises a dielectric substrate 1201 and thin radiators 1202 arranged in a rectangular lattice on the top surface of the dielectric substrate. The bottom surface of the dielectric substrate is either metal-plated or mounted on a separate antenna ground plane 1203 made of a conductive material of high mechanical strength such as metal or a carbon reinforced composite.

Figure 13:
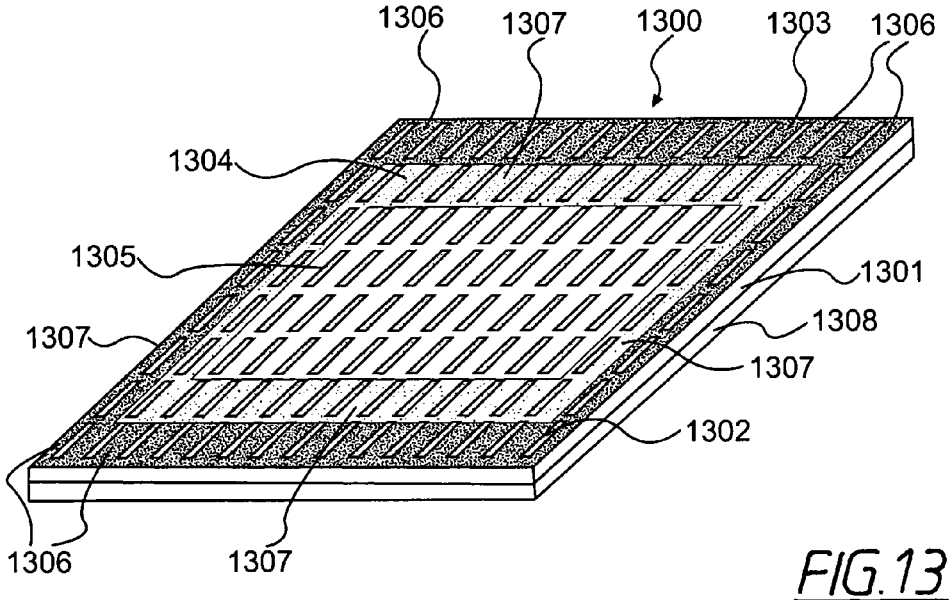
FIG. 13 schematically shows a perspective view of a dipole array antenna according to the invention with resistively coated transition around a dipole array antenna.

FIG. 13 shows an embodiment of an array antenna 1300 with thin radiators 1302 on a dielectric substrate 1301 over a separate antenna ground plane 1308 being in electrical contact with the hull or fuselage. Edge radiators in a first "ring" 1303 are surrounded by four thin strips of resistive sheets 1306 having a low resistivity. The four thin strips of resistive sheets 1306 have holes for the radiators 1302. Edge radiators in a second "ring" 1304 are also surrounded by a second set of four thin strips of resistive sheets 1307 but with a higher resistivity. The radiators in the central antenna area, as 1305, are not surrounded by any strips of resistive sheet. This solution will provide a tapered adjustment of the reflection coefficient over a wide frequency interval thus enabling a low RCS. The transition region for this embodiment comprises the area of the two "rings", covered by thin strips of resistive sheets 1306 and 1307, and the central antenna area is within these two "rings". Within the transition region each radiator is thus surrounded by a corresponding thin resistive sheet.

In order to minimize RCS it is important that the radiators with the corresponding resistive sheets surrounding each radiator are arranged in substantially the same plane as the surrounding hull or fuselage, the difference being only the thicknesses of the radiators and resistive sheets and possibly also the thickness of an environmental protective skin covering the antenna area and overlapping also part of the hull or fuselage area.

Figure 14:
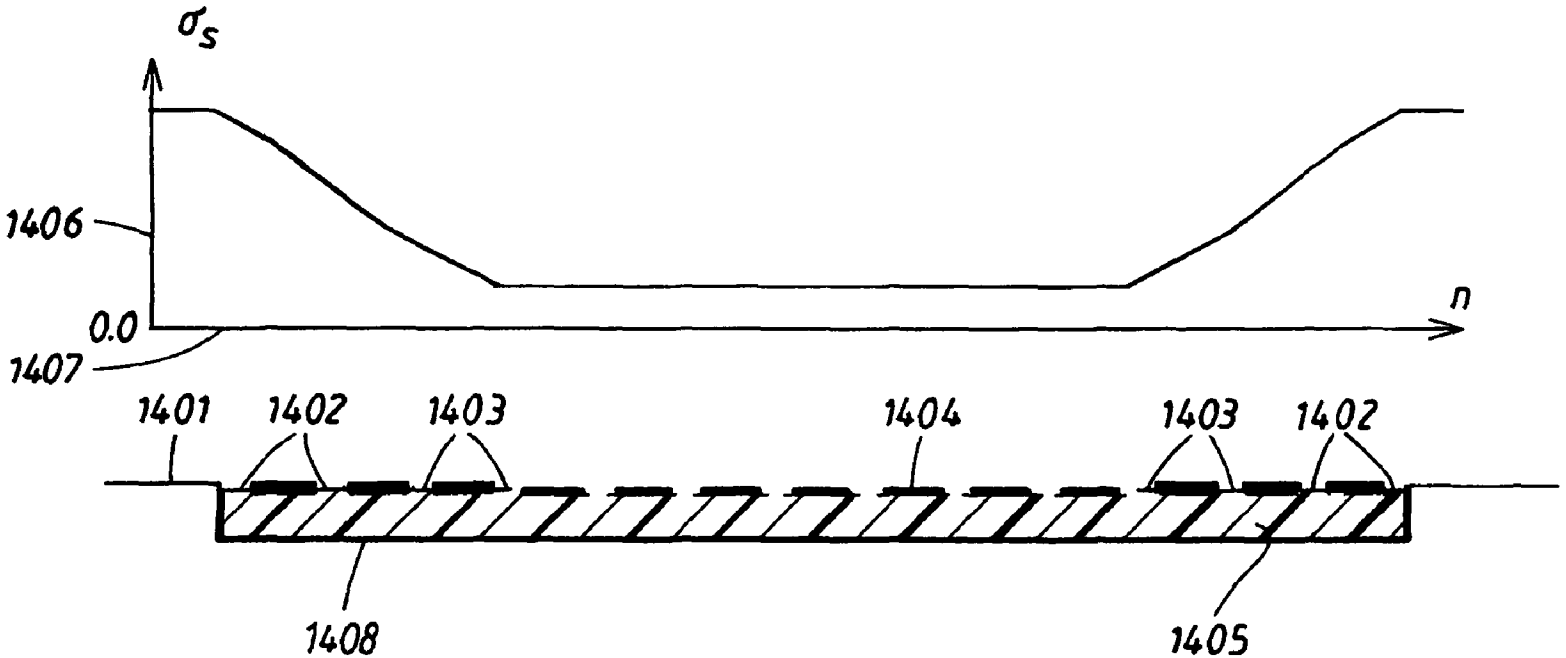
FIG. 14 schematically shows a cross section of a dipole/patch embodiment of the invention.

FIG. 14 shows a cross section of an array antenna according to the invention realized with a dielectric substrate 1405 with thin radiators 1404 being at essentially the same height as the surrounding hull or fuselage 1401. The dielectric substrate with a separate antenna ground plane 1408 is mounted in an aperture in the hull or fuselage and flush mounted to the hull or fuselage as described for the slot element array above. The outer radiators are surrounded by the thin strips of resistive sheets 1402 and 1403 as described in association with FIG. 13.

The variation of the surface conductivity along the surface of the antenna array is shown in the diagram in FIG. 14 where a vertical axis 1406 represents the surface conductivity $\sigma_s$ and a horizontal axis 1407 represents the position of each antenna element n. Consequently, the reflection coefficient is high at the hull or fuselage area as the hull or fuselage is a good reflector when the hull or fuselage is made of materials such as metal or carbon reinforced composite. In the middle of the antenna the reflection coefficient $\Gamma$ is low and in the transition region, i.e. the region with the strips of resistive sheets 1402 and 1403, the unit cell reflection coefficient $\Gamma$ is gradually reduced towards the central antenna area.

The radiators are connected using standard feeds, e.g. slots or probes. If standard type PCB materials are used as the dielectric substrate the radiators can be arranged in the outer layer of the PCB and feeding lines can be in a second layer beneath the outer layer.

The dielectric substrate is advantageously mounted on a metal plate or other conductive material that can give a strong mechanical design and at the same time serve as a separate antenna ground plane. Instead of the metal plate as the separate antenna ground plane, the ground plane can be a layer in a PCB or a thin conductive layer at the bottom surface of the dielectric substrate.

The dielectric substrate and separate antenna ground plane can be flat or curved so as to conform to the surrounding hull or fuselage.

FIGS. 15*a-d* shows radiators 1501 arranged in different lattice configurations, as e.g. quadratic 1503, rectangular 1504, hexagonal 1505 and skewed 1506, usable for the invention. The hexagonal lattice is also a skewed type of lattice. The radiators can be slots, crossed-slots, circular or rectangular holes, dipoles, patches etc. The distance between elements should be around $\lambda_{min}/2$ where $\lambda_{min}$ is the minimum wavelength within the operating frequency range of the antenna.

Figure 15:
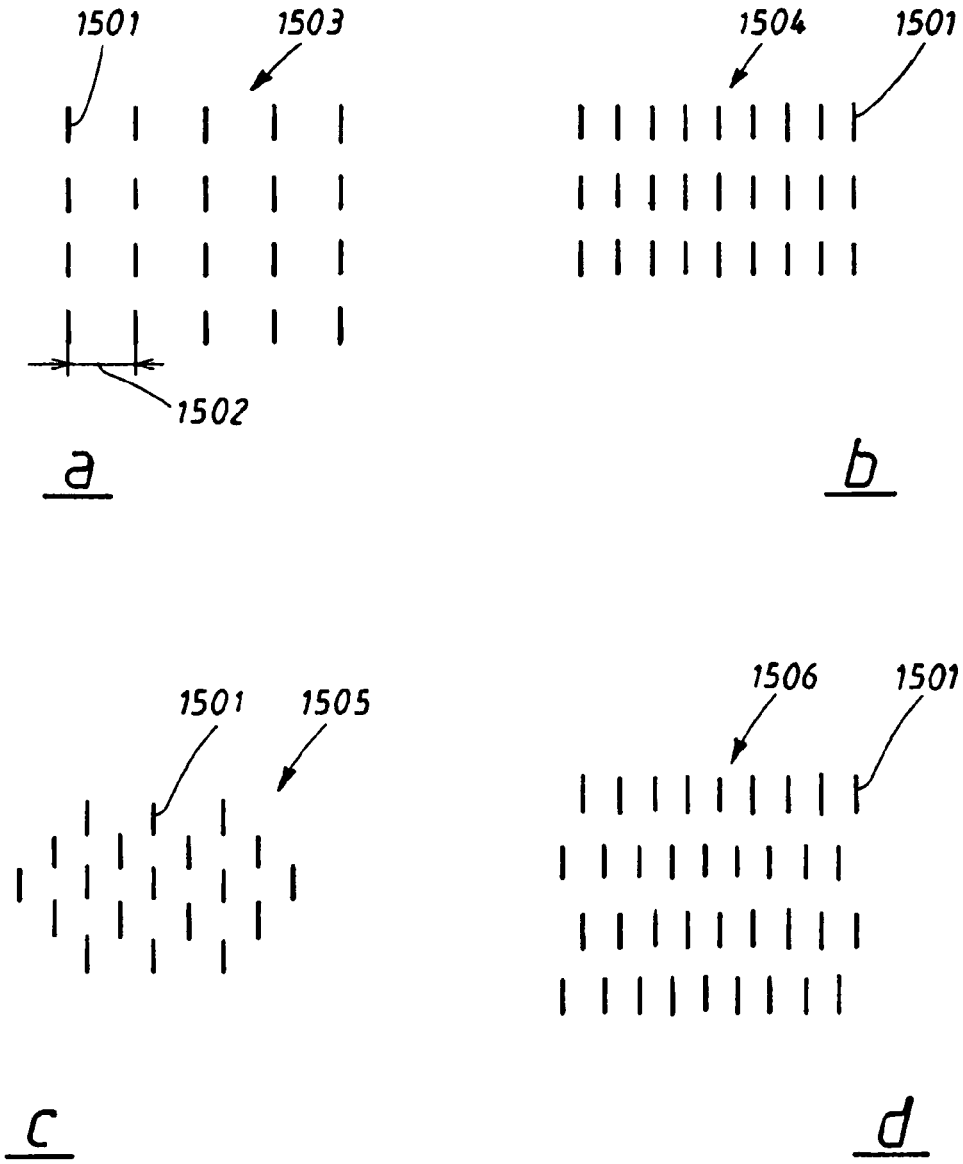
FIG. 15 schematically shows different lattice configurations.

Regularly repeated patterns of reflectivity in an array antenna will cause grating lobes. This is not desirable as it will increase the RCS as discussed above. If the distance between elements in the lattice becomes bigger than $\lambda_{threat\text{-}min}/2$, where $\lambda_{threat\text{-}min}$ is the shortest wavelength issued by a threatening radar system, RCS grating lobes will be returned. It is therefore desirable to keep an element separation 1502 below $\lambda_{threat\text{-}min}/2$. By using a skewed or hexagonal lattice as shown in FIGS. 15*c* and 15*d*, onset or appearance of RCS grating lobes are moved to higher frequencies than is the case for a rectangular or quadratic lattice.

As mentioned above some, or all, of the radiators in the transition region, i.e. radiators covered or surrounded with a thin resistive layer, can preferably be dummy elements if there is a need to transmit at high power. A dummy element is advantageously terminated with an impedance mimicking the impedance of what the active radiating elements see downwards, all to eliminate electrical discontinuities that lead to backscattering.

Figure 16:
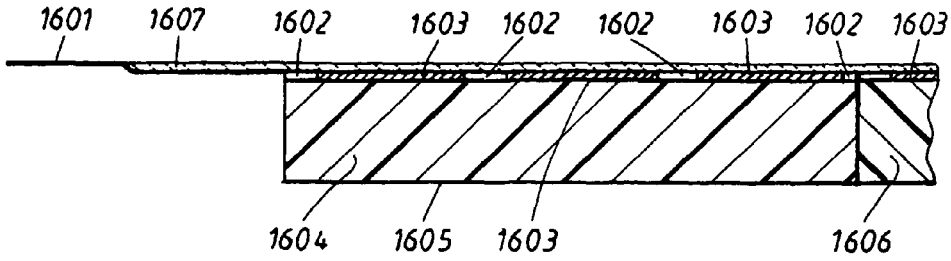
FIG. 16 schematically shows a cross section of an antenna according to the invention with bulk absorbers.

The solution with a dielectric substrate and thin radiators is most efficient for TE-incidence, but not for TM incidence. A solution to this problem is to introduce bulk absorbers or vertically, or substantially vertically, oriented resistive cards. Another problem that can be solved by using bulk absorbers or vertically oriented resistive cards is the surface wave propagation within the antenna substrates. A TM-polarized surface wave will, after being converted to a TEM-like wave between the thin strips of resistive sheets 1306, 1307, 1402, 1403, 1602 and 1703 and the ground plane under the dielectric substrate, be attenuated by the bulk absorbers or vertically oriented resistive cards. FIG. 16 is a cross section of an end section of a dielectric substrate embodiment of the invention with a hull or fuselage 1601, a dielectric substrate 1606, a separate antenna ground plane 1605 in electric contact with the surrounding hull or fuselage, a resistive sheet 1602, with increasing resistivity towards the centre, and radiators 1603, where the properties of a bulk absorber 1604 or vertically oriented resistive cards, changes from absorbing at the edges to a low loss dielectric material in the central antenna area 1112 when the bulk absorbers or vertically oriented resistive cards are implemented as shown in FIG. 16. A bulk absorber or vertically oriented resistive cards thus replaces the dielectric substrate under a part of the transition region. A bulk absorber is typically a dielectric material with RF-absorbing properties as well known to the skilled person. An environmental protective skin 1607 may cover the antenna structure and overlap part of the hull or fuselage area. The top surface of the environmental protective skin is flush with the hull or fuselage surface or protruding over the hull or fuselage surface with the thickness of the environmental protective skin.

Figure 17:
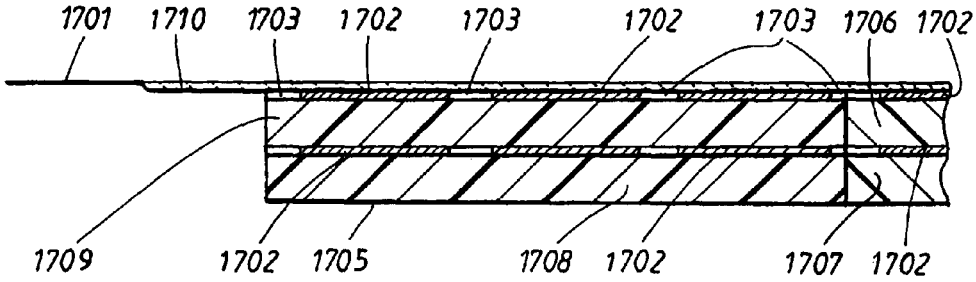
FIG. 17 schematically shows a cross section of an embodiment of the invention with two layers of dielectric substrates with radiators.

If the antenna structure, the end section of which is shown in FIG. 17 with a hull or fuselage 1701 and a separate antenna ground plane 1705, has its radiators 1702 distributed in more than one plane, the invention allows that strips of resistive sheets 1703 are introduced in the top radiator layer. The radiators and corresponding resistive sheets in the top layer is arranged in substantially the same plane as the surrounding hull or fuselage. In this embodiment the antenna structure comprises two stacked dielectric substrates 1706 and 1707, each with radiators, where the dielectric substrates has been replaced by bulk absorbers 1708 and 1709 at the end sections under a part of the transition region. An environmental protective skin 1710 may cover the antenna structure in the same way as described in association with FIG. 16.

The shape of the dielectric substrate and separate antenna ground plane can be flat or curved so as to conform to the surrounding hull or fuselage.

In an embodiment of the invention the array antenna is integrated in a hatch to the hull or fuselage. When integrating the antenna in the hatch, mechanical design consideration must be made concerning to what extent the hatch should be able to take up load.

In the FIGS. 16 and 17 the radiators and the resistive sheets have, for clarity reasons, been illustrated as having the same thickness. This can however vary, typically the resistive sheets are thinner but the opposite may also be true.

Depending on the surface properties of the dielectric plug, dielectric substrates or metallic radiators, it might be necessary to cover the antenna area 1103 with a thin environmental protection skin.

The invention claimed is:

1. An antenna structure integrated in a hull or fuselage, the antenna structure comprising:

an array antenna comprising a number of antenna elements, each antenna element comprising a radiator and an RF-feed, the antenna elements being arranged in a lattice within an antenna area comprising a central antenna area and a transition region outside the central antenna area, the array antenna further comprising a plurality of resistive sheets, wherein a number of the antenna radiators and resistive sheets are arranged in substantially a same plane as a surrounding outer surface of the hull or fuselage, wherein the antenna radiators are slot radiators, and wherein slot radiators in the transition region are covered with the resistive sheets.

2. The antenna structure according to claim 1, wherein the resistive sheets have a high conductivity in a transition region close to the hull or fuselage and wherein a conductivity of the resistive sheets decreases in a direction towards the central antenna area, thus providing a tapered adjustment in a reflection coefficient over a wide frequency interval.

3. The antenna structure according to claim 1, wherein the antenna radiators are filled with dielectric material and RF-energy is fed into a cavity and wherein the slots are made directly in the hull or fuselage.

4. The antenna structure according to claim 1, wherein the antenna radiators are filled with dielectric material and fed via a probe in a cavity and wherein the slots are made in a plate inserted into the hull or fuselage such that a surface of the plate conforms to the surface of the hull or fuselage.

5. The antenna structure according to claim 4, the plate has a curved surface.

6. The antenna structure according to claim 5, wherein the plate comprises metal or carbon reinforced composite.

7. The antenna structure according to claim 3, wherein the cavity is filled with a dielectric material.

8. The antenna structure according to claim 7, wherein the slot radiator and the cavity are filled with the same dielectric material.

9. The antenna structure according to claim 3, wherein a conductivity of walls of the slots is increased by suitable surface treatment.

10. The antenna structure according to claim 3, wherein the resistive sheets are slot shaped.

11. The antenna structure according to claim 1, wherein the transition region outside the central antenna area comprises one ring of antenna radiators covered with the resistive sheets, wherein the resistive sheets are slot shaped.

12. The antenna structure according to claim 1, wherein the transition region outside the central antenna area comprises at least two rings of radiators covered with the resistive sheets, wherein the sheets are slot shaped, wherein a first ring closest to the hull or fuselage comprises resistive sheets with a low resistance and following rings have slots covered with resistive sheets having a resistance becoming higher the closer the ring is to the central antenna area.

13. The antenna structure according to claim 1, wherein the hull or fuselage has a curved surface.

14. The antenna structure according to claim 1, wherein at least one of the antenna radiators in the transition region outside the central antenna area is inactive.

15. The antenna structure according to claim 1, wherein the antenna area is covered with a thin environmental protection skin.

16. The antenna structure according to claim 1, wherein the hull or fuselage is the outer surface of an aircraft, artillery shell, missile or ship.

17. The antenna structure according to claim 1, wherein the antenna is integrated in a hatch covering an opening in the hull or fuselage.

18. An antenna structure integrated in a hull or fuselage, the antenna structure comprising:

an array antenna comprising a number of antenna elements, each antenna element comprising a radiator and an RF-feed, the antenna elements being arranged in a lattice within an antenna area comprising a central antenna area and a transition region outside the central antenna area, the array antenna further comprising a plurality of resistive sheets, wherein a number of the antenna radiators and resistive sheets are arranged in substantially a same plane as a surrounding outer surface of the hull or fuselage, wherein the antenna radiators comprise conductive elements surrounded by strips of resistive sheets in the transition region outside the central antenna area and mounted on a dielectric substrate having a top surface conforming to the outer surface of the hull or fuselage and a bottom surface to which a separate antenna ground plane is applied.

19. The antenna structure according to claim 18, wherein the resistive sheets have a high conductivity in a transition region close to the hull or fuselage and wherein a conductivity of the resistive sheets decreases in a direction towards the central antenna area, thus providing a tapered adjustment in a reflection coefficient over a wide frequency interval.

20. The antenna structure according to claim 18, wherein the antenna radiators are mounted on at least two layers of dielectric substrates having a top layer with a top surface and a bottom layer with a bottom surface to which a separate antenna ground plane is applied, wherein the top surface conforms to the outer surface of the of the hull or fuselage, and wherein the antenna radiators in the top layer and within the transition region outside the central antenna area are surrounded by strips of resistive sheets.

21. The antenna structure according to claim 18, wherein the separate antenna ground plane comprises a conductive material of high mechanical strength.

22. The antenna structure according to claim 18, wherein the antenna radiators in the transition region outside the central antenna area are surrounded by one ring of the strips of resistive sheets.

23. The antenna structure according to claim 18, wherein the transition region outside the central antenna area comprises at least two rings of antenna radiators, the antenna radiators being surrounded by the strips of resistive sheets, wherein a first ring closest to the hull or fuselage comprises resistive sheet strips with a low resistance and following rings comprises strips of resistive sheets having a resistance becoming higher the closer the ring is to the central antenna area.

24. The antenna structure according to claim 18, wherein the dielectric substrate under a part of the transition region outside the central antenna area is replaced by bulk absorbers or vertically oriented resistive cards.

25. The antenna structure according to claim 18, wherein the antenna radiators comprise metal.

26. The antenna structure according to claim 18, wherein at least one of the dielectric substrate or the separate antenna ground plane comprise high mechanical strength materials.

27. The antenna structure according to claim 18, wherein the hull or fuselage has a curved surface.

28. The antenna structure according to claim 18, wherein at least one of the antenna radiators in the transition region outside the central antenna area is inactive.

29. The antenna structure according to claim 18, wherein the antenna area is covered with a thin environmental protection skin.

30. The antenna structure according to claim 18, wherein the hull or fuselage is the outer surface of an aircraft, artillery shell, missile or ship.

31. The antenna structure according to claim 18, wherein the antenna is integrated in a hatch covering an opening in the hull or fuselage.

* * * * *